US008138952B2

(12) United States Patent
Müller-Siebert et al.

(10) Patent No.: US 8,138,952 B2
(45) Date of Patent: Mar. 20, 2012

(54) SAMPLE HOLDER AND ASSEMBLY FOR THE ELECTRODYNAMIC FRAGMENTATION OF SAMPLES

(75) Inventors: Reinhard Müller-Siebert, Bern (CH); Christoph Anliker, Langenthal (CH); Peter Hoppe, Stutensee (DE); Josef Singer, Eggenstein-Leopoldshafen (DE)

(73) Assignee: selFrag AG, Kerzers (CH)

( * ) Notice: Subject to any disclaimer, the term of this patent is extended or adjusted under 35 U.S.C. 154(b) by 229 days.

(21) Appl. No.: 12/525,278

(22) PCT Filed: Mar. 16, 2007

(86) PCT No.: PCT/CH2007/000144

§ 371 (c)(1),
(2), (4) Date: Jul. 30, 2009

(87) PCT Pub. No.: WO2008/113189

PCT Pub. Date: Sep. 25, 2008

(65) Prior Publication Data

US 2010/0025240 A1 Feb. 4, 2010

(51) Int. Cl.
*B02C 19/00* (2006.01)

(52) U.S. Cl. ..... 341/1; 241/301

(58) Field of Classification Search ..... 241/1, 301
See application file for complete search history.

(56) References Cited

U.S. PATENT DOCUMENTS 3,416,128 A 12/1968 Allen
3,604,641 A 9/1971 Wilson et al.
4,759,905 A * 7/1988 Walter et al. ..... 419/23
5,945,036 A * 8/1999 Reitz ..... 252/572
2005/0051644 A1* 3/2005 Paris et al. ..... 241/1
2005/0124842 A1 6/2005 Paris et al.
2010/0213052 A1* 8/2010 McAlister ..... 204/261

FOREIGN PATENT DOCUMENTS

DE 38 44 419 A1 7/1989

(Continued)

OTHER PUBLICATIONS

International Search Report for International Application No. PCT/CH2007/000144, dated Dec. 3, 2007.

(Continued)

*Primary Examiner* — Bena Miller
(74) *Attorney, Agent, or Firm* — Marshall, Gerstein & Borun LLP

(57) ABSTRACT

The invention relates to a sample holder having an insulation body (10; 50) and a first electrode (3; 33) and a second electrode (4; 34), wherein the first electrode (3; 33) and the second electrode (4; 34) project into the sample container (2; 32), the first electrode (3; 33) and the second electrode (4; 34) are connected to each other via the insulation body (10; 50), the sample container (2; 32) is filled with a dielectric liquid (5; 35), and the first electrode (3; 33) is assigned to a gas collection chamber (6; 36). The invention further relates to an assembly for the electrodynamic fragmentation of samples (38), having such a sample container (2; 32), a process container (22; 41), and means (24, 27; 39, 39.1, 39.2, 40, 43) for connecting the first electrode (3; 33) and the second electrode (4; 34) of the sample container (2; 32) to a high voltage source (42), wherein the process container (22; 41) is filled with a dielectric liquid (46), and the sample container (2; 32) is arranged inside the process container (22; 41) in the dielectric liquid (46).

20 Claims, 5 Drawing Sheets

FOREIGN PATENT DOCUMENTS

| | | | |
|---|---|---|---|
| DE | 38 44 419 | A1 | 7/1989 |
| EP | 1 266 693 | A2 | 12/2002 |
| EP | 1 266 693 | A2 | 12/2002 |
| EP | 1 266 693 | B1 | 10/2005 |
| GB | 1289121 | | 9/1972 |
| GB | 1289122 | | 9/1972 |
| JP | 2005512073 | A | 4/2005 |
| SU | 1 741 900 | | 6/1992 |
| SU | 1 781 892 | | 8/1996 |
| WO | WO 03050208 | A2 | 6/2003 |

OTHER PUBLICATIONS

International Search Report in corresponding PCT/CH2007/000144, dated Dec. 4, 2007.

Translation of the first Office Action for Japanese Patent Application No. 2009-553878, dated Aug. 3, 2011.

* cited by examiner

SAMPLE HOLDER AND ASSEMBLY FOR THE ELECTRODYNAMIC FRAGMENTATION OF SAMPLES

TECHNICAL FIELD

The invention relates to a sample container according to the preamble of claim 1, and an assembly for the electrodynamic fragmentation of samples according to the preamble of claim 15. Fragmentation refers to the splitting and/or breaking up of a sample into smaller fragments. A sample container of this type and an assembly of this type for the electrodynamic fragmentation of samples can be used in the analysis of mineral samples, for example.

PRIOR ART

To allow the examination and analysis of samples in the form of material samples, it is frequently necessary to fragment the samples, and in this fragmentation not merely to crush them, but also to break them down as selectively as possible into their constituent parts. Currently, mills or crushers or similar devices that employ a mechanical process for fragmentation are customarily used to fragment material samples.

The fragmentation of material samples using pulsed high voltage discharges is characterized by a comparatively higher degree of selectivity. The constituents of a sample can be more effectively separated in the fragmentation or crushing process than with a mechanical fragmentation process. A particularly selective fragmentation can be achieved when the high voltage breakdown occurs through the solid object that forms the sample, along grain boundaries and non-homogeneities in the material of the sample. This type of fragmentation is called electrodynamic fragmentation, and involves the use of correspondingly high field intensities or voltages. In so-called electrohydraulic fragmentation, the samples are fragmented or crushed using shock waves, which are generated with the high voltage breakdown in a dielectric liquid, usually water, which surrounds the sample. Electrodynamic fragmentation generally requires higher electric field intensities than electrohydraulic fragmentation, but as a rule provides better selectivity.

The level of precision required for the analysis of samples usually lies in the ppm range (parts per million) or the ppt range (parts per trillion). Thus even small amounts of contaminants can adulterate the results of analysis. One potential source of contamination is the assembly that is used to fragment the samples. For instance, a contamination of the samples may be attributable to wear debris from the means or tools used for the fragmentation (so-called inherent contamination) or to traces of samples previously handled in the assembly that were not completely removed (so-called cross-contamination). With the known fragmentation methods, a combination of inherent contamination and cross-contamination is generally to be expected. For example, when mills or crushers are used to fragment samples via a mechanical fragmentation process, an inherent contamination of the sample by the tools used for the fragmentation is unavoidable due to the forces of friction and shearing. A cross-contamination of the samples can be diminished by cleaning the fragmentation assembly, however with the known assemblies such contamination cannot be completely prevented. Moreover, a cleaning process of this type is generally complex and costly.

From the U.S. Pat. No. 3,604,641 a sample container and an assembly for the electrohydraulic fragmentation of samples are known, wherein the sample container has two electrodes arranged opposite one another, and is filled with a suitable liquid, generally water, and is positioned in the assembly for electrohydraulic fragmentation. The electrodes of the sample container are connected in series with two additional electrodes, between which a gas gap is located. The sample container is pulsed with voltage pulses via a single-stage capacitor discharge circuit and the gas gap. The sample container can be removed from the assembly following fragmentation of samples held in the sample container, and disposed of once the fragmented samples have been removed.

DESCRIPTION OF THE INVENTION

The object of the present invention is to provide a multiple-use sample container and a multiple-use assembly for the electrodynamic fragmentation of samples, with which a cross-contamination of the samples to be fragmented can essentially be completely prevented.

This object is attained with a sample container having the characterizing features of Claim 1, and with an assembly for the electrodynamic fragmentation of samples having the characterizing features of Claim 15.

The sample container of the invention comprises an insulating body and first and second electrodes. The first and second electrodes project into the interior of the sample container and are connected to one another via the insulating body. The sample container is filled with a dielectric liquid, wherein the first electrode is assigned a gas collection chamber, which may also be characterized as a gas plenum. The first electrode is preferably arranged at the top of the sample container, while the second electrode is preferably arranged at the bottom, opposite the first electrode.

In the fragmentation of samples using pulsed high-voltage discharges, gas typically forms in the interior of the sample container in the form of gas bubbles, with the gas bubbles ordinarily collecting on the upper interior side of the sample container. Because of the electric fields that are also created on the upper interior side of the sample container during fragmentation using pulsed high-voltage discharges, the gas bubbles that collect there can lead to undesirable surface discharges along the interior walls or sides of the sample container and/or high-voltage breakdowns or high-voltage spark-overs along the interior and/or exterior sides and/or walls of the sample container. This can result in a shortening of the service life of the sample container and to its destruction or to its structural failure. The sample container of the invention has a gas collection chamber, in which the gas that is created during the fragmentation using pulsed high-voltage discharges can collect. The gas collection chamber is preferably located in a space which during operation is substantially field free within the field unloading, so that the gas or the gas bubbles cannot cause surface discharges or high-voltage breakdowns or high-voltage spark-overs. Gas that may be present or released during fragmentation and can collect in the gas collection chamber can be removed from the sample container of the invention—in the same manner as the fragmented samples—for the purpose of analysis.

The sample container is advantageously a stand-alone element, so that a different sample container can be used for each sample or each sample material. In this way, cases of cross-contamination caused by using the same sample container for the fragmentation of different samples can be prevented. Once the fragmented samples and/or the gas that has collected in the gas collection chamber have been removed, the sample container of the invention can be disposed of.

The assembly of the invention for the electrodynamic fragmentation of samples comprises a process container, a sample container according to the invention, and means for connecting the first and second electrodes of the sample container to a high-voltage source, especially a high-voltage pulse generator. The process container is filled with a dielectric liquid, and the sample container is arranged inside the process container in the dielectric liquid. Thus in the assembly of the invention, a dielectric liquid, especially water, is present both inside the sample container and outside the sample container.

In this manner, the sample container is insulated against surface discharges on its interior and in the exterior space that surrounds the sample container. This effectively increases the service life of the sample container and thus of the assembly of the invention for the electrodynamic fragmentation of samples. The assembly and the sample container can be operated using pulse voltages of up to 300 kV, with which a breakdown (so-called solid-state breakdown) through samples measuring up to a few centimeters can be achieved, resulting in a highly selective fragmentation of the samples.

According to one preferred embodiment of the assembly of the invention for the electrodynamic fragmentation of samples, a field shaping component is located in the process container, which encompasses the sample container like a sheath. By providing the field shaping component between the interior wall of the process container and the exterior wall of the sample container, the electric fields that are created during fragmentation using pulsed high-voltage discharges are shaped and/or controlled in such a way that high field intensities of this type are prevented from developing along the interior and/or the exterior side or wall of the sample container, which could cause its destruction and/or structural failure.

BRIEF DESCRIPTION OF THE DRAWINGS

Additional advantageous embodiments of the invention are presented in the dependent claims and in the exemplary embodiments described in what follows in reference to the set of drawings. The drawings show:

In the figures, the same reference symbols are used to designate structurally and/or functionally equivalent components. The figures are not true to scale.

Possible Configurations of the Invention

Figure 1:
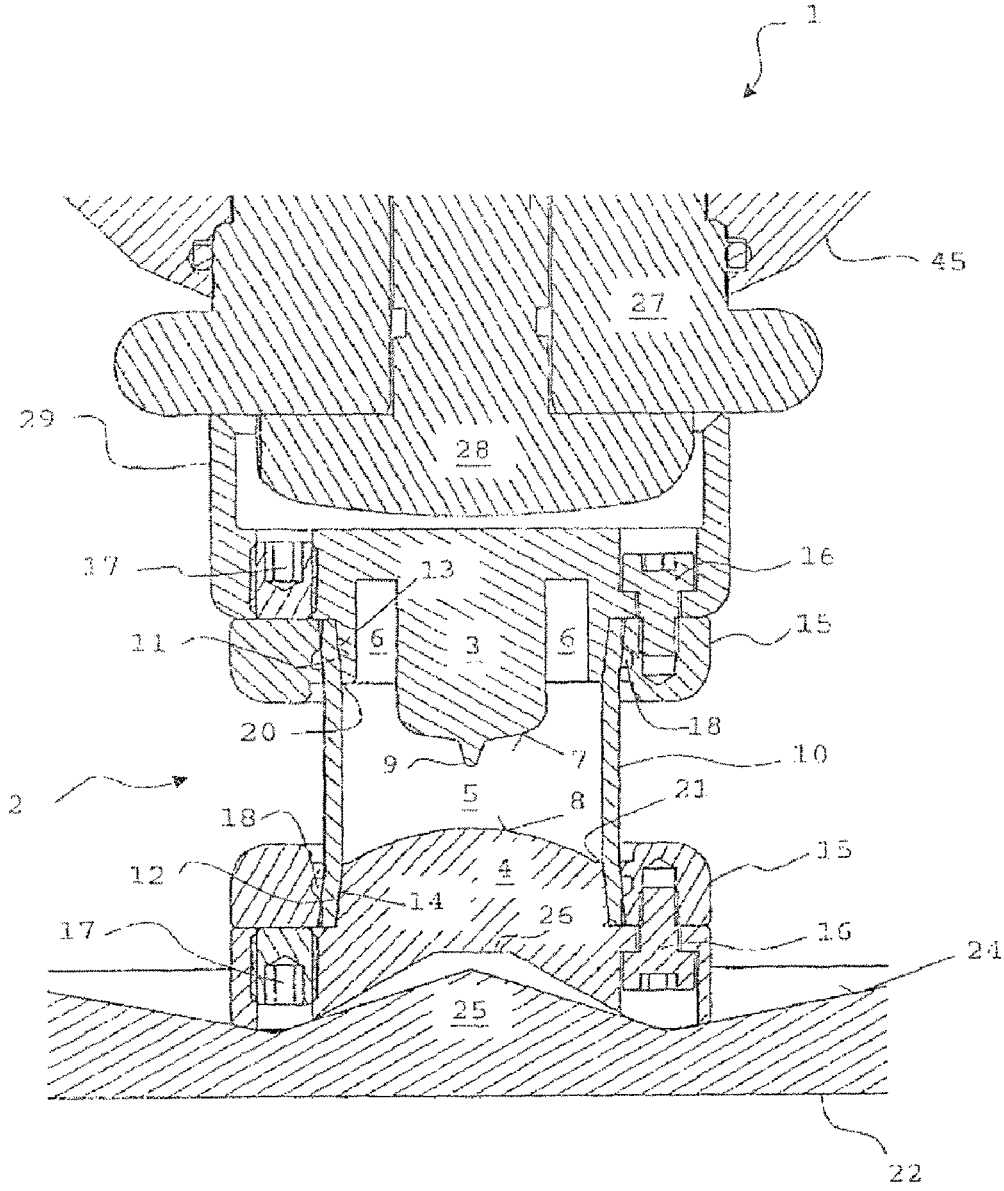
in FIG. 1, a cross-section of a section of a first exemplary embodiment of an assembly of the invention, with a first exemplary embodiment of a sample container according to the invention, in FIG. 2, potential lines on the right side of the assembly shown in FIG. 1, in FIG. 3, a schematic representation of a second exemplary embodiment of an assembly according to the invention, with a second exemplary embodiment of a sample container according to the invention, in FIG. 4, field lines in an assembly according to FIG. 3, without field shaping component (FIG. 4*a*), field lines in another assembly according to FIG. 3 without field shaping component (FIG. 4*b*), field lines in an assembly according to FIG. 3 with field shaping component (FIG. 4*c*), and in FIG. 5, a cross-section of a section of an assembly according to the invention, as is represented schematically in FIG. 3.

FIG. 1 shows a cross-section of a part of a first exemplary embodiment of an assembly 1 according to the invention, in which a first exemplary embodiment of a sample container 2 of the invention is arranged. The sample container 2 comprises a first, upper electrode 3 and a second, lower electrode 4. The sample container 2 is filled with a dielectric liquid 5, especially water. A gas collection chamber 6 is assigned to the upper, first electrode 3, and surrounds the area of the first electrode 3 that projects into the sample container 2 preferably in an annular fashion, in such a way that the end area 7 of the first electrode 3 is located in the dielectric liquid 5. In the gas collection chamber 6, the electric field that prevails during the fragmentation process is very low.

The first electrode 3 preferably projects further into the sample container 2 than the second electrode 4. The end area 7 of the first electrode 3 which projects into the sample container 2 is preferably at least partially conically tapered in configuration and preferably has a centrally located projection 9. The end area 8 of the second electrode 4 which projects into the sample container 2 is preferably configured as a spherical segment.

The sample container 2 has an insulating body 10, which connects the first electrode 3 to the second electrode 4. The insulating body 10 is preferably configured as a hollow cylinder. The insulating body 10 is preferably made of a flexible material, especially at its end areas 11, 12. When assembled, the end areas 11, 12 of the insulating body 10 are in contact with sealing surfaces 13, 14 of the first and second electrodes 3, 4, which preferably widen in a conical shape toward the outside. During assembly, the end area 12 is drawn over the sealing surface 14 of the second electrode 4, preferably causing it to widen toward the outside in a conical shape as a result of the conical shape of the sealing surface 14, so that a clamping connection is formed between the end area 12 and the sealing surface 14. A clamping collar 15 is pushed or slid over the insulating body 10, especially its end areas 11, 12. The dielectric liquid 5 and the sample material, which is not more specifically identified, are then added, especially avoiding the entrapment of any gas. The sealing surface 13 of the first electrode 3 is then introduced into the insulating body 10 and is placed in contact with its end area 11, which causes this area to widen, preferably as a result of the conical shape of the sealing surface 13, so that a clamping connection is formed between the end area 11 and the sealing surface 13. The clamping connection between the insulating body 10 and the first and second electrodes 3, 4, which is created as a result of the conical shape of the sealing surfaces 13, 14 of the first and second electrodes 3, 4 and the flexible material of at least the end areas 11, 12 of the insulating body 10, advantageously creates a highly effective sealing and tightness of the sample container 2. Finally, the clamping rings 15 are pulled in the direction of the electrodes 3, 4 via several tightening screws 16 assigned to them, which forces them against the end areas 11, 12, creating an even firmer connection between the end areas 11, 12 of the insulating body 10 and the sealing surfaces 13, 14 of the electrodes 3, 4. For the removal and/or for the disassembly of the sample container 2 and/or the insulating body 10, ejection screws (or recesses, especially bore holes, for ejection screws) 17 are provided, the actuation of which moves the respective clamping rings 15 in a vertical direction toward the center of the insulating body 10, thus pushing them away from the end areas 11, 12, resulting in a release of the clamping connection between the end areas 11, 12 of the insulating body 10 and the respective sealing surfaces 13, 14 of the electrodes 3, 4.

To further improve the sealing and tightness of the sample container 2, the clamping rings 15 are equipped on their respective interior sides with clamping grooves 18, which prevent the insulating body 10 from slipping and/or sliding off of a sealing surface 13, 14 of one of the electrodes 3, 4 during the fragmentation of a sample. The clamping grooves 18 may also be characterized as retention grooves or barbed grooves. It is thereby possible to exclude open areas on the walls or sides and/or the end surfaces of the sample container 2, which could cause a high electric field super-elevation and thus in a spark over the surface of the insulating body 10, which would result in a destruction of the insulating body 10 and thus of the sample container 2.

Figure 2:
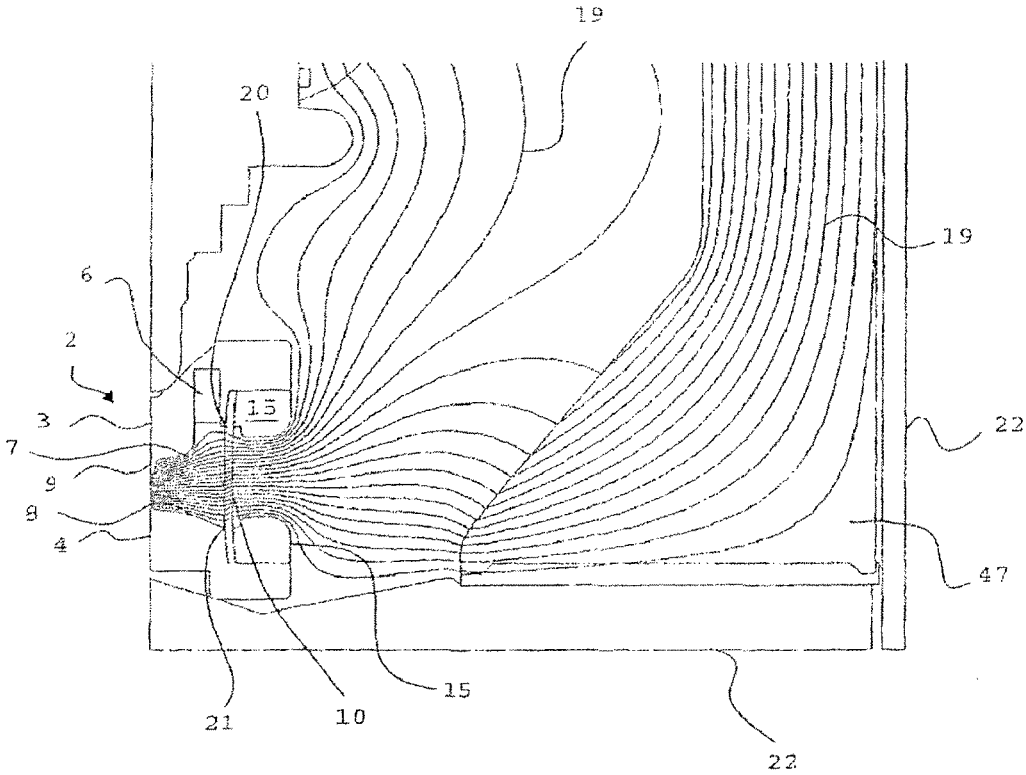

Between the end areas 11, 12, the wall of the insulating body 10 extends preferably as linearly as possible and perpendicular to the potential and/or electric field lines 19 that occur during operation (cf. FIG. 2). The clamping rings 15 are preferably shaped such that the potential lines 19 and the electric field lines extend substantially perpendicular to the wall of the insulating body 10. To this end, the clamping rings 15 have a flat surface, not specified in greater detail, on their side that faces the respective other clamping ring 15, with said surface transitioning toward the outside in a convex shape into a perpendicular surface. With the perpendicular arrangement of the wall of the insulating body 10 in relation to the potential lines 19 or the electric field lines, local electric field super-elevations on the insulating body 10, and thus a destruction of the insulating body 10, can be prevented.

The first electrode 3 is preferably embodied such that a first, upper triple point 20, located between the first electrode 3, the insulating body 10 and the dielectric liquid 5, is electrically unloaded, so that substantially no electron emission occurs at the upper triple point 20, which could cause a spark over the surface of the insulating body 10 and thus a destruction of the insulating body 10. For this purpose, the end area 7 of the first electrode 3, which projects into the sample container 2, is preferably conically tapered in configuration, and is especially equipped with the centrally arranged projection 9 (see FIG. 2).

Correspondingly, the second electrode 4 is preferably embodied such that a second, lower triple point 21, which is situated between the lower electrode 4, the insulating body 10 and the dielectric liquid 5, is electrically unloaded, so that substantially no electron emission can occur at the lower triple point 21 either, which could lead to a spark over the surface of the insulating body 10. For this purpose, the end area 8 of the second electrode 4 is preferably embodied as a spherical segment (see FIG. 2). Also in FIG. 2, a field shaping component 47 is provided between the outer wall of the sample container 2 and the inner wall of the process container 22. The field shaping component 47 and its function will be described in detail further below in reference to FIGS. 3 through 5.

The gas collection chamber 6 assigned to the first electrode 3 is used to collect gas or gas volumes that are created during the fragmentation process, specifically at a distance from the interior surface of the insulating body 10 and thus also spaced from the upper triple point 20. Thus the electric fields that prevail during the fragmentation process, especially the electric fields that prevail at the upper triple point 20, are substantially unimpaired by the gas that is created, so that high-voltage spark-overs on the wall of the insulating body 10 can be prevented.

The material of the insulating body 10 is, or the insulating body 10 is made of, PE (polyethylene), which is characterized by a high breakdown resistance, specifically it is preferably made of LDPE (low density polyethylene), which is characterized by high ductility. The wall of the insulating body 10 is preferably 1 mm thick. This serves to ensure that the insulating body 10, and thus the sample container 2, can withstand the forces that arise during the fragmentation process, or that the walls of the insulating body 10 are able to absorb these forces without sustaining damage.

The simple geometry of the insulating body 10 enables its cost-effective production, which is advantageous especially because this allows the sample container 2 and/or the insulating body 10 to be exchanged after each fragmentation of a sample, in order to prevent cross-contamination and/or for safety reasons to prevent any possible structural fatigue.

The sample container 2 is arranged in a process container 22 of the assembly 1 for the fragmentation of samples. The lower, second electrode 4 is arranged on a base 24 of the process container 22, wherein the base 24 is preferably equipped with means 25 for accommodating the lower, second electrode 4 in the form of an elevation 25 configured to accommodate a depression 26 in the lower, second electrode 4 on the side of the base. In this manner, the second, lower electrode 4 can be prevented from sliding laterally, which could cause the insulating body 10 to slide off of the sealing surfaces 13 and/or 14. If the insulating body 10 were to slide off of the sealing surfaces 13, 14, this would lead to a destruction of the insulating body 10 and thus of the sample container 2.

A high-voltage electrode 27, which is connected to the first electrode 3, is assigned to the process container 22. The high-voltage electrode 27 is preferably assigned a high-voltage insulator 45, which encompasses said electrode in an annular fashion. The high-voltage electrode 27 preferably surrounds a mounting component 28 in an annular fashion. The mounting component 28 can be a mounting screw, for example, which is screwed into the high-voltage electrode 27. On the side of the high-voltage electrode, the first electrode 3 preferably has an outer, annular edge 29, which surrounds the mounting component 28 when it is in contact with the high-voltage electrode 27. The mounting component 28 prevents the first electrode 3 from sliding laterally, which could cause the insulating body 10 to slide off of the sealing surfaces 13, 14. Thus the first electrode 3 can advantageously be held in position by the mounting component 28.

With the assembly 1 for the fragmentation of samples and the sample container 2 represented in FIG. 1, even the smallest samples weighing less than 4 grams can be fragmented, without the destruction of the sample container 2 and a resulting loss of sample material. The sample container 2 shown in FIG. 1 can therefore also be characterized as a micro sample capsule. At a sparking voltage of 80 kV, for example, it can withstand 24 high-voltage pulses.

Figure 3:
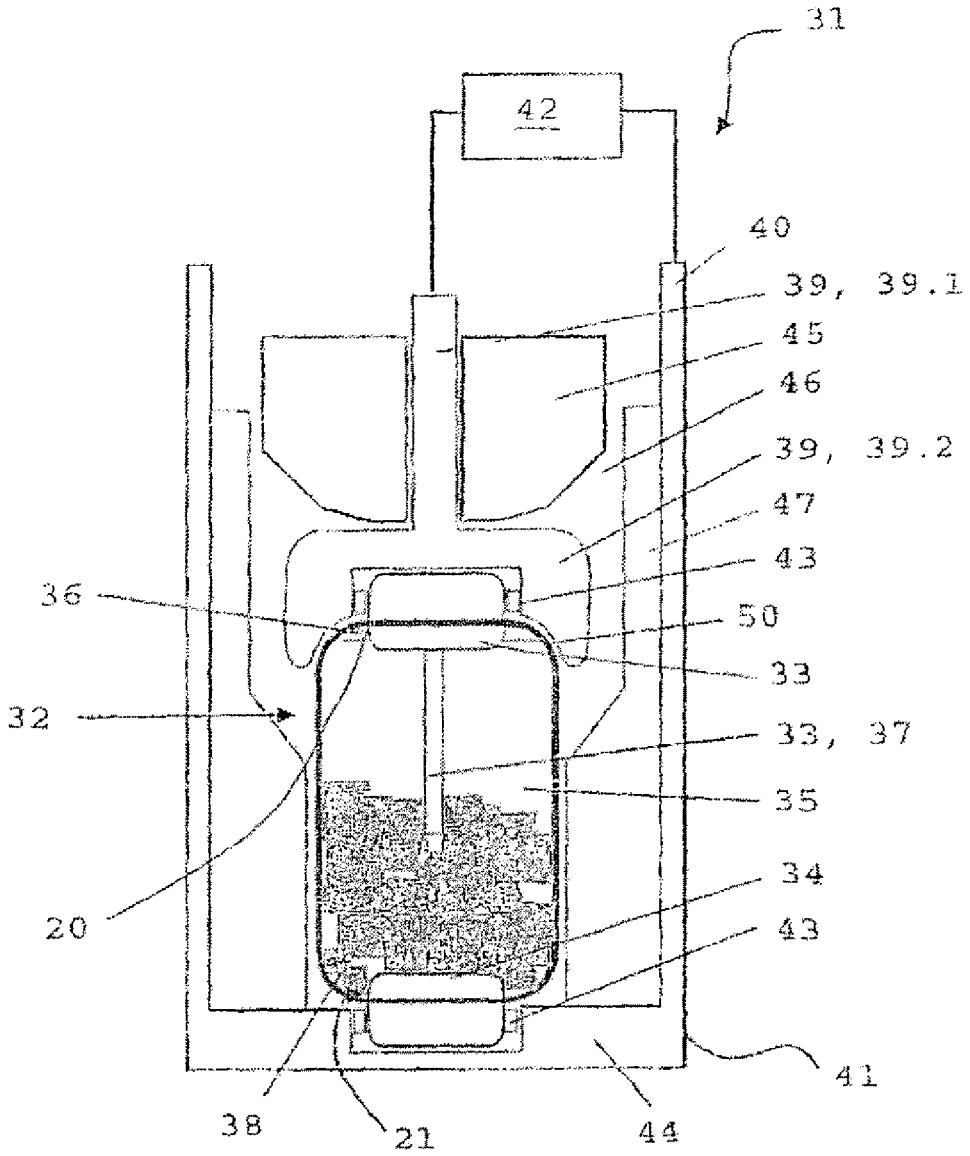

FIG. 3 shows a second exemplary embodiment of an assembly 31 for the fragmentation of samples according to the invention, with a second exemplary embodiment of a sample container 32 according to the invention, which comprises an insulating body 50. A first, upper electrode 33 and a second, lower electrode 34 are arranged in the sample container 32. The first electrode 33 and the second electrode 34 are preferably each integrated into a short side of the sample container 32. The sample container 32 is filled with a dielectric liquid 35, especially water. The dielectric liquid 35 at least partially covers an end area 37 of the first electrode 33, configured as a pin, wherein the end area 37 projects into the sample container 32. In the upper area of the sample container 32 a gas collection chamber 36 is provided, which serves to capture and collect gas bubbles that are created during fragmentation.

Sample material or samples 38 to be fragmented are placed in the sample container 32. Once the samples 38 have been placed in the sample container 32, the container is filled with the dielectric liquid 35, especially avoiding the entrapment of any gas. The first electrode 33 and the second electrode 34, which are discharge electrodes, are then connected to pad electrodes 39, 40 of the process container 41, and via these are connected to a high-voltage pulse generator 42. The connection of the first electrode 33 and the second electrode 34 to pad electrodes 39, 40, respectively, is preferably accomplished via a contact 43, which can especially be a resilient contact strip.

The lower, second electrode is preferably embodied as a ground electrode, which is connected to a pad electrode 40, which is formed by the housing 44 of the process container 41. The upper pad electrode 39, which is connected to the first, upper electrode 33, is arranged, preferably centrally, in the process container 31, and has an electrode rod 39.1 and an electrode reservoir 39.2, which accommodates the first electrode 33, wherein the edges of the electrode reservoir 39.2, which are not specified in greater detail, are connected to the first electrode 33 via the contact 43. The electrode reservoir 39.2 is connected to the high-voltage pulse generator 42 via the electrode rod 39.1. The pad electrode 39 comprising electrode rod 39.1 and electrode reservoir 39.2 is preferably embodied as a single piece. The electrode rod 39.1 is preferably encompassed in an annular fashion by a high-voltage insulator 45.

The electrode reservoir 39.2 functions as a field unloader. The gas collection chamber 36 is advantageously arranged in a substantially field-free space inside the unloaded field, so that the gas that is collected in the gas collection chamber 36 has substantially no effect on the high-voltage breakdown generated during fragmentation. For this purpose, the gas collection chamber 36 is preferably arranged inside the electrode reservoir 39.2.

The process container is filled with a dielectric liquid 46, which is preferably water, wherein the sample container 32 arranged in the process container 41 is completely surrounded by the dielectric liquid 46. Of course, dielectric liquids other than water may also be used for the dielectric liquids 35 and 46.

The first, upper electrode 33 is preferably embodied such that a triple point 20, located between the first electrode 33, the insulating body 50 and the gas collection chamber 36, is electrically unloaded, so that substantially no electron emission occurs at the triple point 20. Such an electron emission could cause a spark-over on the surface of the insulating body 50 and thus a destruction of the insulating body 50.

The second, lower electrode 34 is preferably embodied such that a triple point 21, located between the second electrode 34, the insulating body 50 and the dielectric liquid 35, is electrically unloaded, so that substantially no electron emission occurs at the triple point 21.

In the process container 41 or in the housing 44 of the process container 41, a field shaping component 47 is arranged, which surrounds the sample container 32 like a sheath. The field shaping component 47 is therefore provided between the interior wall of the housing 44 of the process container 41 and the exterior wall of the sample container 32. Preferably, the material of the field shaping component 47 is plastic, or the field shaping component 47 is made of plastic, especially HDPE (high density polyethylene). This material allows the field shaping component 47 to withstand even high stresses in the form of voltage pulses, without being destroyed. At the level of the upper half of the sample container 32, which is not specified in greater detail, the field shaping component 47 preferably widens conically, transitioning to a section having a greater interior diameter, which is not specified in greater detail. The enlargement of the interior diameter of the field shaping component toward the top creates space to accommodate the high-voltage insulator 45 and the electrode reservoir 39.2.

By providing the field shaping component 47, the electric fields that are created during fragmentation are influenced or controlled in such a way that substantially no unallowably high electric field intensities, which could lead to a destruction of the sample container 32 and/or the process container 41, can occur along the interior or the exterior wall of the sample container 32 or of the insulating body 50.

Figure 4:
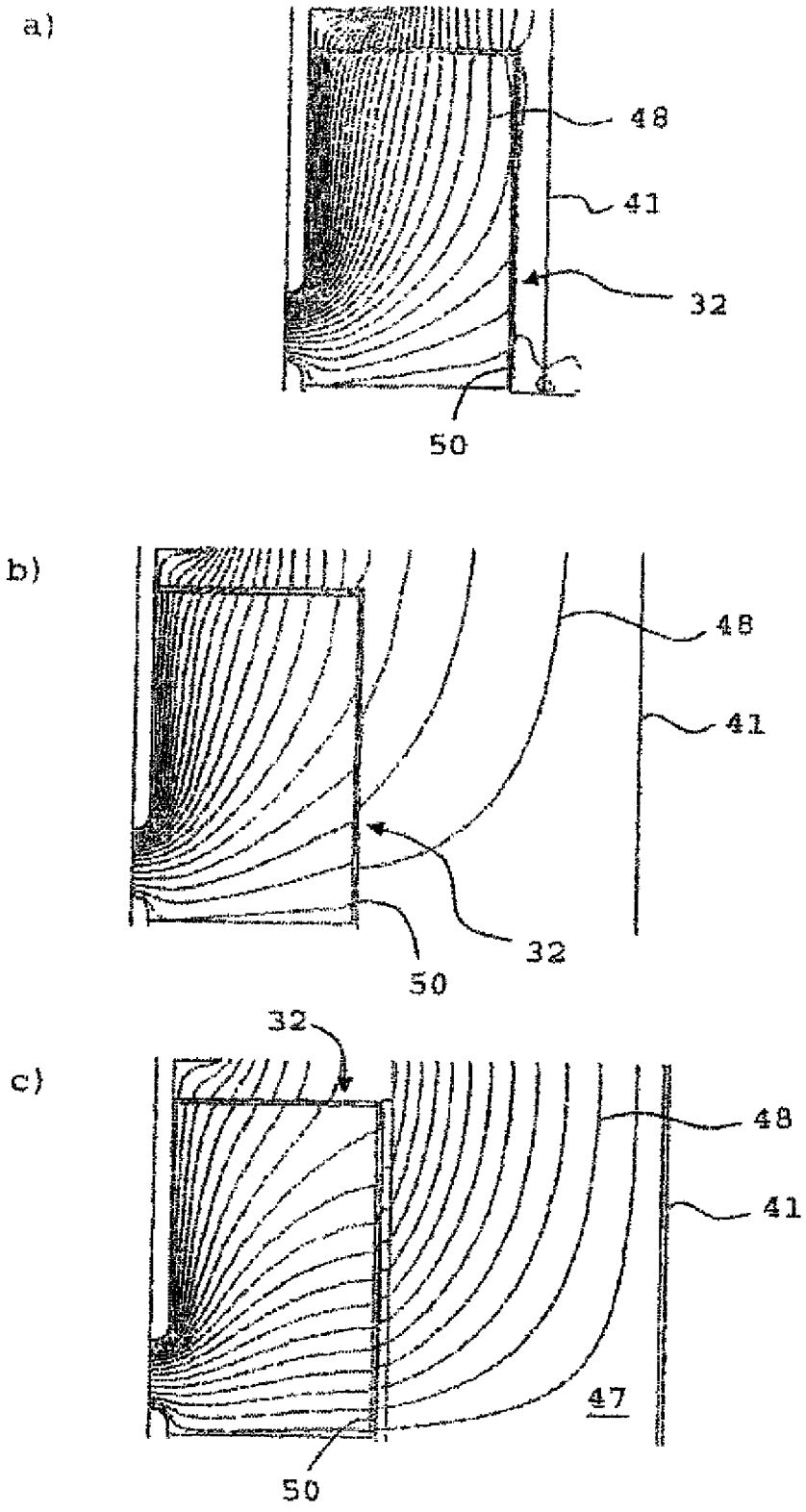

FIG. 4 shows the paths of the electric field lines 48 in a section on the right of the process container 41, from the perspective of an observer, with a sample container 32 arranged inside said container. In FIGS. 4*a* and 4*b*, no field shaping component is provided, wherein in FIG. 4*a*, the distance between the exterior wall of the sample container 32 and the interior wall of the process container 41 is chosen to be significantly smaller than in FIG. 4*b*. In FIGS. 4*a* and 4*b*, the respective field lines 38 extend over a relatively long distance inside the wall of the insulating body 50 or the sample container 32. The field lines 38 lie close to one another, which is characteristic of an electric field superelevation. In FIG. 4*c*, a field shaping component 47 is provided between the exterior wall of the sample container 32 and the interior wall of the process container 41. This has the effect that the field lines, as compared with FIGS. 4*a* and 4*b*, extend only short distances through the wall of the insulating body 50 or the sample container 32 and lie spaced father from one another, therefore they exert less of a load on these.

In the assembly shown in FIG. 3, pulsed, high-intensity high-voltage discharges are generated between the first electrode 33 and the second electrode 34 by means of the high-voltage pulse generator 42 for the purpose of fragmenting the samples 38. For example, voltage pulses having a pulse duration of up to a few microseconds, with voltage peaks of several 100 kV, especially up to 300 kV, and current intensities of up to 10 kA, can be generated using the high-voltage pulse generator 42. Following the generation of a certain number of pulsed high-voltage discharges by the high-voltage pulse generator 42, with the number of pulsed high-voltage discharges being smaller than the number allowed for the sample container 32, the sample material 38 is fragmented and the sample container 32 can be separated from the pad electrodes 39, 40 of the high-voltage pulse generator, and can be removed, unopened, from the assembly 31. If the sample container 32 was completely cleaned or unused and new prior to fragmentation, then after the fragmentation it can contain only solid, liquid and/or gaseous constituents of that fragmented sample material that was fragmented during the most recent use of the sample container. The sample container 32 can thus contain only contaminants created during the fragmentation, for example as a result of abrasive wear of the material of the first and second electrodes 33, 34 and the insulating body 50 (so-called inherent contamination). In principle, this inherent contamination can be influenced and minimized by a suitable selection of the material of the first and second electrodes 33, 34 and—with respect to the quantity of the contaminants—by a suitable selection of the discharge parameters of the high-voltage pulse generator 42. The discharge parameters of the high-voltage pulse generator 42 are determined, for example, by the duration of the current/voltage pulses, the height of the voltage peaks and the current intensities. Cross-contamination from previously fragmented samples is advantageously prevented by the one-time use or the thorough cleaning of the sample container 32. For the fragmentation of new samples, new or thoroughly cleaned first and second electrodes 33, 34 are also preferably used. It is further provided that the sample container 32 will withstand and will remain sealed against the load peaks caused by the high-voltage discharges, so that no material exchange can occur between the sample container 32 and the process container 41. In order to ensure that the sample container 32 or the insulating body 50 of the sample container 32 will withstand and will remain sealed against the load peaks, it preferably contains polyethylene as a material, or is preferably made of polyethylene, especially LDPE (low density polyethylene).

The distance between the surfaces of the first and second electrodes 33, 34 that face one another preferably amounts to a few centimeters. The sample container 32 preferably has a volume of between 0.25 and 0.5 liters, and is used as a single-use sample container. It is preferably configured such that it can withstand pulse loads of up to several 100 kV, especially up to 300 kV, occurring during fragmentation with respect to the high voltage to be insulated, the high current intensities that occur as a result of this, especially up to 10 kA, or the high wattages associated with this, especially up to 100 megawatts, and the pressure peaks within the sample container 32 caused by this, for a certain number of high-voltage pulses during electrodynamic fragmentation, so that the sample material 38 can be selectively fragmented.

The sample container 32 and the assembly 31 are embodied according to the invention such that they can withstand the shock waves caused by the high-voltage discharges in the dielectric liquid 35 contained in the sample container 32, the high electric field intensities that occur in the wall of the sample container 32 or of the insulating body 50, which is not specified in greater detail, the high electric field intensities that occur in the field shaping component 47, and the impact or the effect of constituents of the sample material that strike the wall of the sample container 32 or the insulating body 50 during fragmentation, over a certain number of high-voltage pulses, without the sample container 32 or the assembly 31 being destroyed or damaged. This is especially achieved through the embodiment of the sample container 32, the provision and the embodiment of the field shaping component 47 and the provision of dielectric liquids 35 or 46, both in the sample container 32 and in the process container 41 of the assembly 31. Thus the sample container 32 of the invention and the assembly 31 of the invention can be used for a series of 300 high-voltage pulses, for example, or can be loaded with up to 300 high-voltage pulses.

Figure 5:
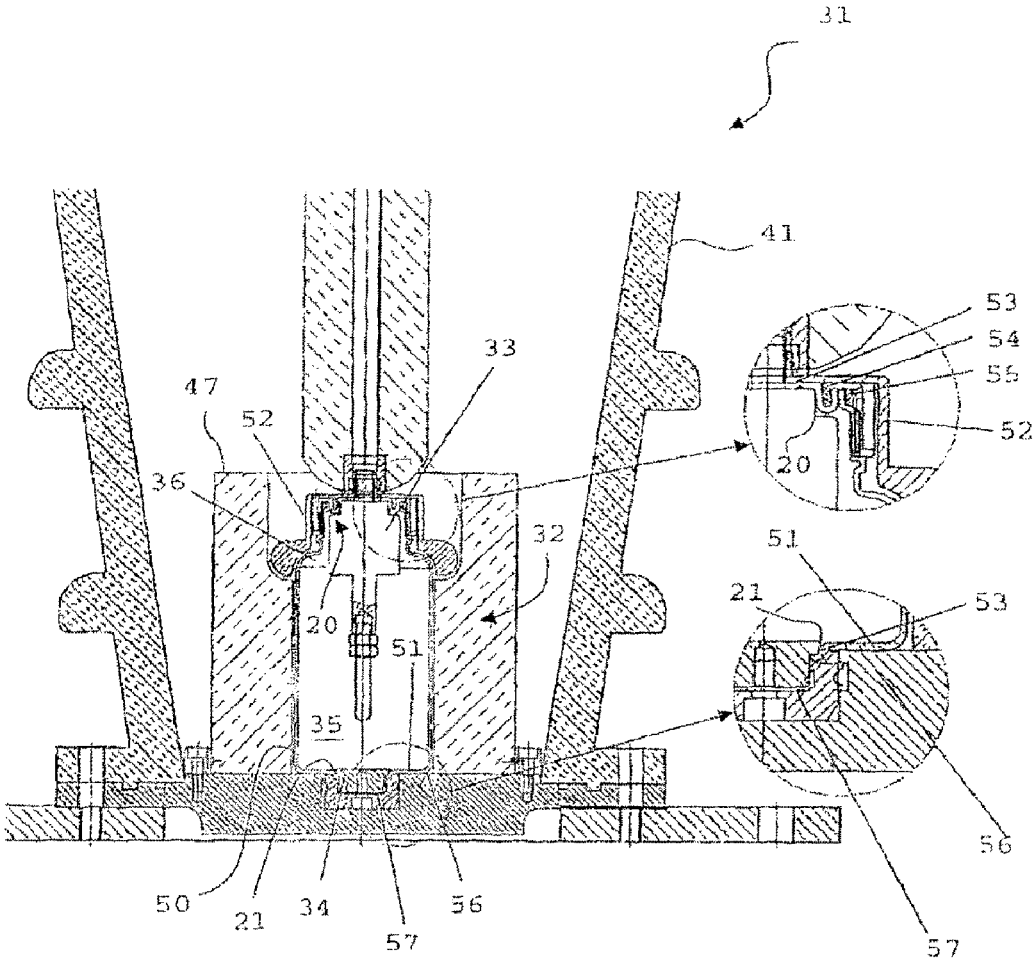

FIG. 5 shows a cross-section of a part of an assembly 31 with a process container 41 and a sample container 32, which is encompassed by a field shaping component 47, as is schematically illustrated in FIG. 3. The process container 32 comprises an insulating body 50 with a base 51. A cover 52 is preferably allocated to the insulating body 50. The material of the sample container 32 or the insulating body 50, which preferably is LDPE (low density polyethylene) or preferably comprises LDPE, also serves as sealing material.

For example, commercially available, wide-necked flasks made of LDPE (low density polyethylene) can be used as sample containers 32, which are preferably replaced after each fragmentation process. For the field shaping component 47 and the first and second electrodes 33, 34, easily producible turned components can be used. Additional smoothing of the surface of the commercially available wide-necked flasks can further improve sealing.

To further improve the sealing of the sample container 32, an upper, cover-side area of the first, upper electrode 33, which is not specified in greater detail, and/or a lower, base-side area of the second, lower electrode 34, which is not specified in greater detail, preferably has sealing grooves 53, which are generated especially during insertion of the first electrode 33 into the cover 52 or during insertion of the second electrode 34 into the base 51 of the insulating body 50, preferably as a result of reshaping during anchoring. Furthermore, preferably during insertion of the first electrode 33, sealing beads, which are not specified in greater detail, are formed in an area of the cover 52 on the electrode side, and/or during insertion of the second electrode 34, sealing beads, not specified in greater detail, are formed in an area of the base 51 of the insulating body 50 on the electrode side.

Moreover, to further improve the sealing of the cover-side end area of the insulating body 50 and/or the insulating body side of the cover 52, support rings 54, 55 in the form of an inner support ring 54 and an outer support ring 55 are provided. The inner support ring 54 is preferably provided inside a cover groove, whereas the outer support ring 55 is arranged on the exterior side or surface of the end area of the insulating body 50. If a wide-necked flask or some other flask is used as the insulating body 50, the outer support ring 55 is arranged on the outside of the flask neck.

Further, in the base 56 of the process container 41, means 57 for accommodating the second electrode 34 are preferably provided, which are preferably embodied as a recessed area 57.

With the assembly 31 and the sample container 32 shown in FIGS. 3-5 samples measuring up to a few centimeters can be selectively fragmented using pulse voltages of up to 300 kV, without the sample container 32 or the insulating body 50 being destroyed by the pulse loads. The lifespan of the sample container 32 and the insulating body 50 is especially increased by the provision of dielectric liquid on the inside and the outside of the sample container 32 and by the provision of a field shaping component 47 and a gas collection chamber 36.

Because of the preferred use of the sample container 32 as a single-use sample container, its components, such as the support rings 54, 55, the insulating body 50 and the first and second electrodes 33, 34 are simple and cost-effective in structure.

Of course, the first exemplary embodiment of the assembly 1 of the invention, shown in FIG. 1, may also be combined with the second exemplary embodiment of the sample container 32 shown in FIGS. 3, 5, or the second exemplary embodiment of the assembly 31 of the invention, shown in FIG. 3, 5, may be combined with the first exemplary embodiment of the sample container 2 of the invention shown in FIG. 1. Furthermore, the characterizing features of the first and second exemplary embodiments of the assembly of the invention, or the characterizing features of the first and second exemplary embodiments of the sample container of the invention may be combined with one another.

The invention is not limited to the above-described embodiments or exemplary embodiments, but can also be configured differently within the scope of the patent claims.

The invention claimed is:

1. Assembly for the electrodynamic fragmentation of samples comprising a process container, a sample container with an insulating body and a first and a second electrode, wherein the first and the second electrode project into the sample container and the first and the second electrode are connected to one another via the insulating body, wherein the sample container is filled with a dielectric liquid and a gas collection chamber surrounding an area of the first electrode that projects into the sample container, and means for connecting the first and second electrodes of the sample container to a high-voltage source wherein the process container is filled with a dielectric liquid, and the sample container is arranged inside the process container in the dielectric liquid.

2. Assembly according to claim 1, wherein a field shaping component is arranged in the process container, which encompasses the sample container like a sheath.

3. Assembly according to claim 1, wherein the material of the field shaping component comprises HDPE.

4. Assembly according to claim 1 the process container has a base, on which the second electrode of the sample container is arranged, and that the base has means, for accommodating the second electrode.

5. Assembly according to claim 4 wherein the means for accommodating the second electrode is an elevation or a recessed area.

6. Assembly according to claim 1 further comprising a mounting component surrounded by the first electrode and holding the first electrode in position.

7. The assembly according to claim 1, wherein the end area of the first electrode which projects into the sample container is at least partially conically tapered in configuration, and/or that the end area of the second electrode which projects into the sample container is configured as a spherical segment.

8. The assembly according to claim 1 characterized in that the first electrode projects further into the sample container than the second electrode.

9. The assembly according to claim 1, wherein the end area of the first electrode which projects into the sample container has a centrally arranged projection.

10. The assembly according to claim 1, wherein a cover is provided, and that the insulating body has a base.

11. The assembly according to claim 10, further comprising at least one support ring on the cover-side end area of the insulating body and/or on the insulating body side of the cover.

12. The assembly according to claim 10, wherein a cover-side area of the first electrode and/or a base-side area of the second electrode have sealing grooves.

13. The assembly according to claim 1, wherein the insulating body is configured as a hollow cylinder.

14. The assembly according to claim 13, wherein the first electrode and the second electrode are each connected via a clamping ring to one end area of the insulating body.

15. The assembly according to claim 14, wherein the clamping rings have clamping grooves.

16. The assembly according to claim 13, wherein the first and/or second electrode each have a sealing surface which widens conically toward the outside, and which is in contact with an end area of the insulating component that widens conically toward the outside.

17. The assembly according to claim 1, wherein the end area of the second electrode which projects out of the sample container has a recessed area.

18. The assembly according to claim 1, wherein the material of the insulating body comprises polyethylene.

19. The assembly according to claim 18, wherein the polyethylene is LDPE.

20. The assembly according to claim 1, further comprising at least one of:

a first triple point located between the first electrode, the insulating body and the dielectric liquid or the gas collection chamber, the first triple point being electrically unloaded, or a second triple point located between the second electrode, the insulating body and the dielectric liquid, the second triple point being electrically unloaded.

* * * * *

UNITED STATES PATENT AND TRADEMARK OFFICE

CERTIFICATE OF CORRECTION

PATENT NO. : 8,138,952 B2
APPLICATION NO. : 12/525278
DATED : March 20, 2012
INVENTOR(S) : Müller-Siebert et al.

It is certified that error appears in the above-identified patent and that said Letters Patent is hereby corrected as shown below:

In the Claims

Column 11, Line 3, in Claim 4, after "claim 1", insert -- wherein --.

Signed and Sealed this
Ninth Day of September, 2014

Michelle K. Lee

Michelle K. Lee
*Deputy Director of the United States Patent and Trademark Office*